US008172735B2

(12) United States Patent
Ayoub et al.

(10) Patent No.: US 8,172,735 B2
(45) Date of Patent: May 8, 2012

(54) AIR-BRAKE SAFETY DEVICE FOR EXERCISE RESISTANCE BAND

(76) Inventors: Victor R. Ayoub, Fort Lee, NJ (US); Lawrence C. Edelman, East Brunswick, NJ (US)

( * ) Notice: Subject to any disclaimer, the term of this patent is extended or adjusted under 35 U.S.C. 154(b) by 0 days.

(21) Appl. No.: 13/270,225

(22) Filed: Oct. 10, 2011

(65) Prior Publication Data

US 2012/0028769 A1 Feb. 2, 2012

Related U.S. Application Data

(63) Continuation of application No. 12/426,278, filed on Apr. 19, 2009, now Pat. No. 8,033,966.

(60) Provisional application No. 60/617,832, filed on Apr. 18, 2008.

(51) Int. Cl.
*A63B 21/02* (2006.01)

(52) U.S. Cl. ..... 482/121; 482/74; 482/91

(58) Field of Classification Search ..... 482/74, 482/91, 121; 434/247
See application file for complete search history.

(56) References Cited

U.S. PATENT DOCUMENTS

| | | | | |
|---|---|---|---|---|
| 5,653,665 | A * | 8/1997 | Neeley | 482/106 |
| 2007/0287614 | A1 * | 12/2007 | Fuller | 482/121 |
| 2008/0096737 | A1 * | 4/2008 | Ayoub | 482/107 |

* cited by examiner

*Primary Examiner* — Glenn Richman
(74) *Attorney, Agent, or Firm* — Lawrence C. Edelman

(57) ABSTRACT

A parachute-like safety device for use with an exercise resistance band. The parachute-like device can attach to the ends of the band to act as handles, and furthermore, such a device can be used at the center portion of a typical exercise resistance band. The benefit of either use, is that in the event of the accidental release (snap back) of any part of the device, the parachute-like device will "catch-air" and function as an air-brake as it is forced to rapidly move through the air, so as to slow down movement of the resistance band and therefore diminish or prevent injury caused by the snap-back effect.

8 Claims, 8 Drawing Sheets

AIR-BRAKE SAFETY DEVICE FOR EXERCISE RESISTANCE BAND

CROSS-REFERENCE TO RELATED APPLICATIONS

For US purposes only, this application claims priority of prior U.S. Provisional Patent Application U.S. Ser. No. 60/617,832, filed Apr. 18, 2008, and is a continuation in part of U.S. patent application Ser. No. 12/426,278, filed Apr. 19, 2009 now U.S. Pat. No. 8,033,966. The entire disclosure of each of these prior patent applications are incorporated herein by reference in their entirety.

BACKGROUND OF THE INVENTION

1. Field of the Invention

This invention relates generally, to exercise devices and more particular to the addition of a safety device for modifying an exercise resistance elastic band.

2. Description of the Prior Art

Exercise devices of the type having elastic resistance bands are well know, see for example the exercise bar of U.S. Pat. No. 4,059,265. One serious drawback of an exercise device of this type having an elastic exercise band is the potential for a snap-back effect if the band breaks or slips off of a retaining position while it is stretched, which snap-back effect can cause the band to hit the user or people nearby, thereby causing a severe bodily injury, as well as property damage.

SUMMARY OF THE INVENTION

The new fail-safe design for the exercise band greatly lowers the risk of snap back or recoil injury to a user of an exercise device which includes an elastic exercise resistance band. In the present invention, a device is added to the band upon which device a resistance effect of wind or air can act, so as to form a type of parachute or air-brake which will slow or stop the snap back effect of the resistance band in the event of a failure or unwanted release of the band from a retained position or mount.

The new design for the exercise band also allows for an easier, more secure, more comfortable and a safer grasping of the ends of the resistance band by the user. More specifically, when the new safety device is added to the resistance band it increases the surface area of a portion of the exercise resistance band device. In one embodiment that portion is an end portion, and preferably both end portions, of the device, which end portions (i.e., the handles) are adapted to be grasped by a user of the resistance band. The new safety device has a shape and texture much different than the user grasped portion of a conventional resistance band device, and has a surface area that greatly reduces the potential snap back effect of the user grasped portion in the event of an unexpected release as compared with the prior art. In a further embodiment, a similar safety device can be located at a point approximately midway between the ends of the resistance band, so as to provide an enlarged surface area that also greatly reduces the snap back effect in the event the mid-point of the resistance band inadvertently and unexpectedly becomes released. Additionally, the surface of the safety device allows for a better/more secure and comfortable stance, whether the safety device is provided at the ends of the band or near it's mid-point when the safety device is held in place by the user's feet or foot, or for a more secure mounting position when the band is held in place by a mount, such as a door mount.

Furthermore, when the center portion of the resistance band also includes the safety device, the exercise resistance band eliminates the need for a separate component to mount the exercise band to a door and also the method by which the design for the exercise band does mount to a door greatly lowers the risk of band snap back or band breakage. Additionally, the mounting techniques possible with the new design, greatly reduces the possibility of the mounting to mar the mounting surface, such as a door frame, as commonly occurs with door mounts for the currently used resistance band exercise devices.

Even further, when the center portion of the resistance band also includes the new device, due to the shorter lengths needed for the resistance portion of the exercise band, the potential for snap back injury due to slippage or failure of any portion of the band, is inherently reduced.

Because of the reduced potential for injury provided by the improved design, users of exercise devices having a resistance band of this new type, in general will feel more confident to use exercise devices, and thus help ensure the completion of regularly scheduled exercise. Additionally, due to the substantial increase in the safety of such resistance band devices, these low-cost and compact exercise devices can now become much more accepted for wide-scale use in the physical education programs of elementary schools, and other public facilities, where "one on one" personal training is generally not available in order to help ensure safe use of such exercise devices. Even furthermore, the safety device offers a place for a personal trainer to grasp the exercise device without having to grasp the resistance band, thereby preventing excessive exposure to rubber products, which can cause an allergic reaction in the personal trainer over time.

BRIEF DESCRIPTION OF THE DRAWINGS

The accompanying drawings, which are incorporated herein and constitute part of this specification, illustrate embodiments and details of the invention, and, together with the general description given above and the detailed description given below, serve to explain the features of the invention.

DETAILED DESCRIPTION OF THE INVENTION

Figure 6:
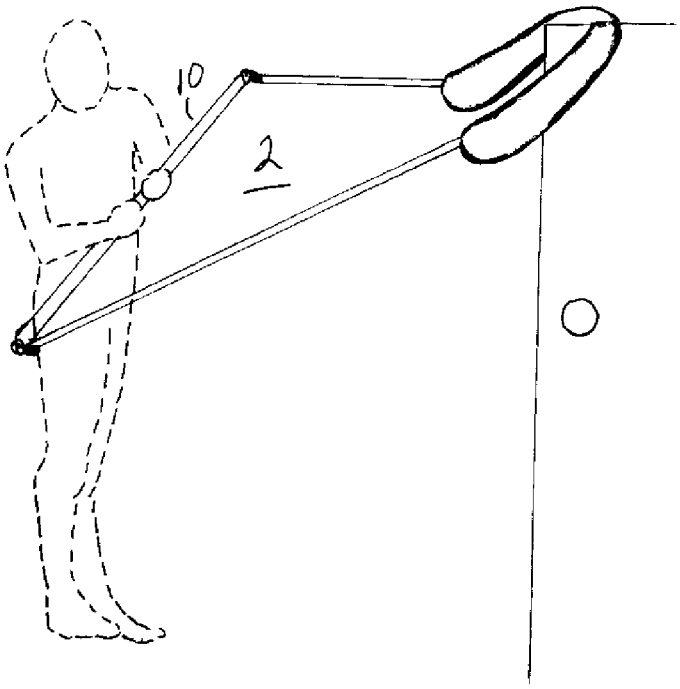
Figure 7A:
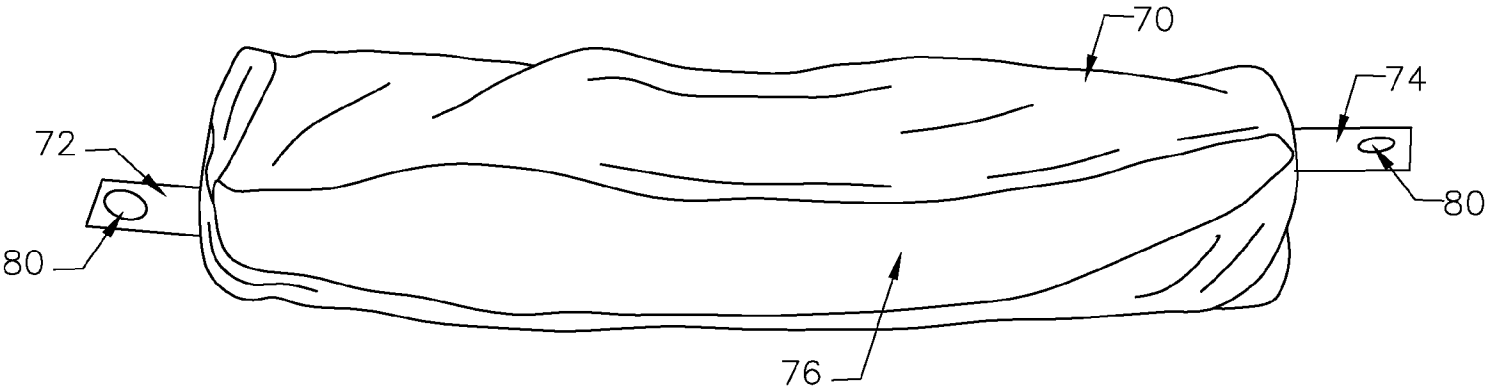
FIGS. 7A, 7B and 7C illustrate further details of the embodiment of the safety device shown in FIGS. 1-6.
Figure 7B:
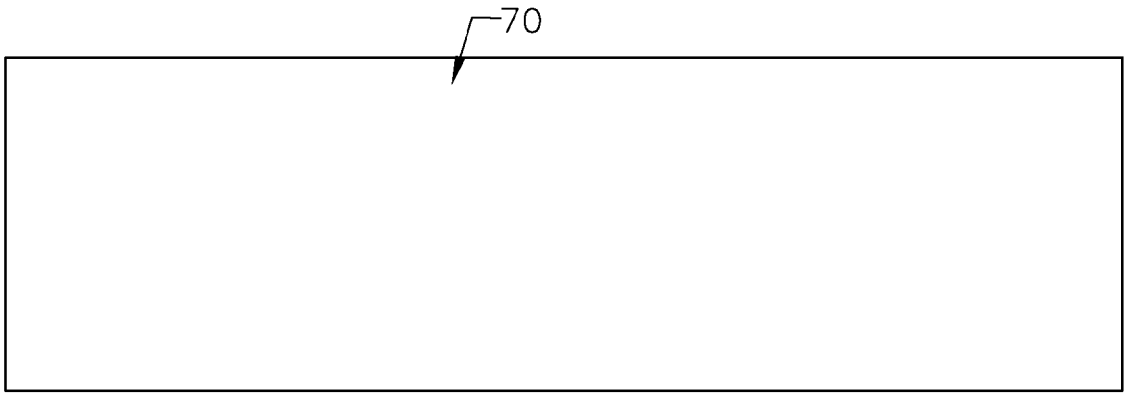
Figure 7C:
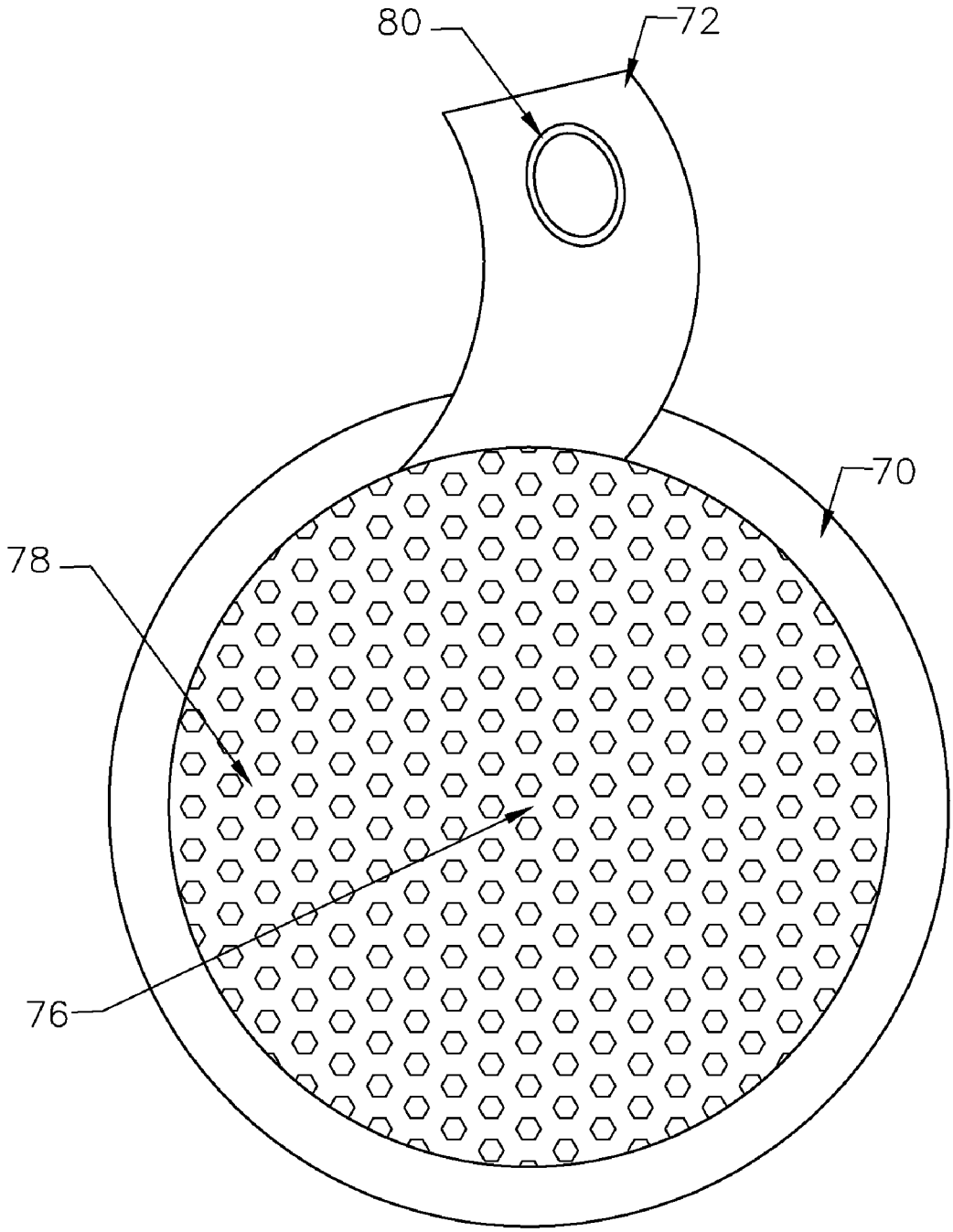
Figure 7D:
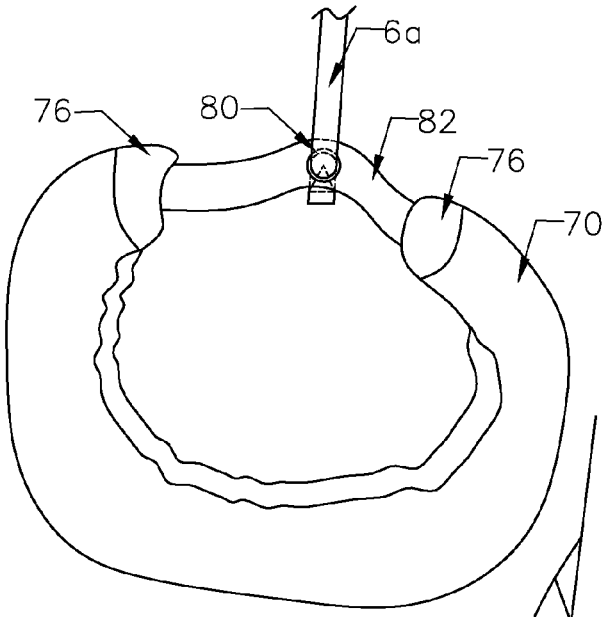
FIGS. 7D, 7E and 7F illustrate the use of the safety device of the present invention as a handle for a resistance band device shown in FIGS. 1-6.
Figure 7E:
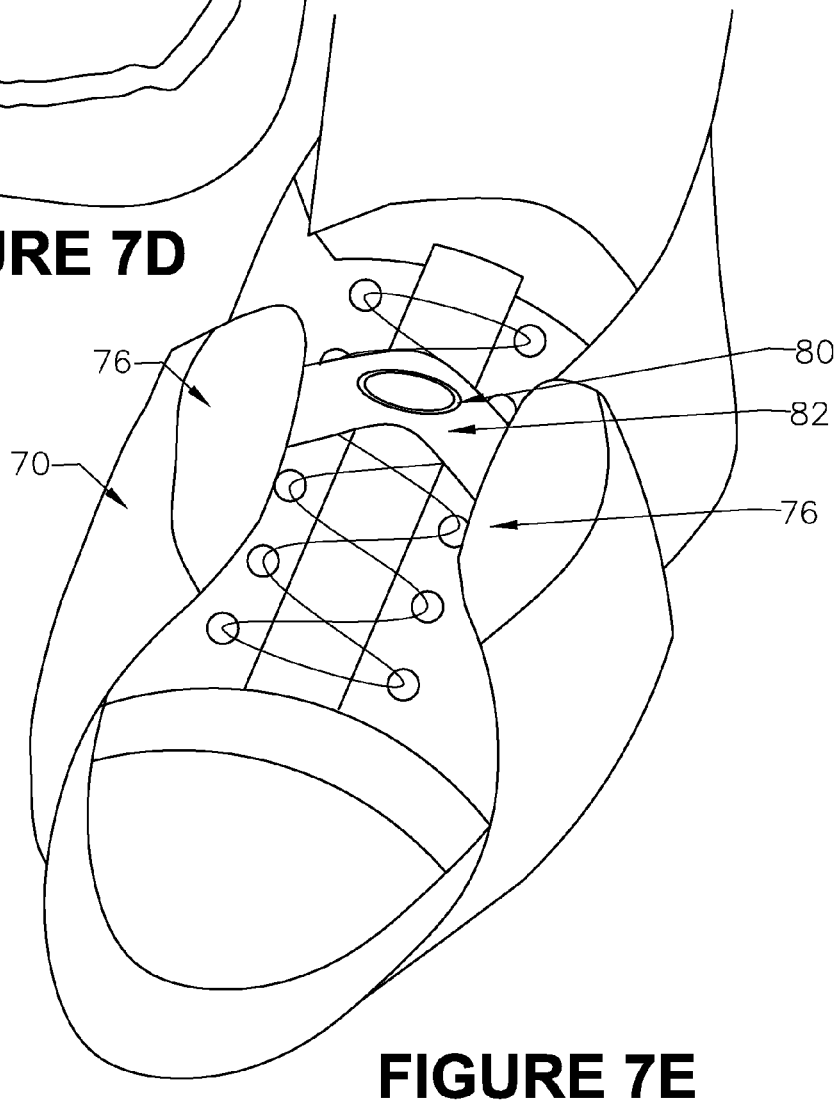
Figure 7F:
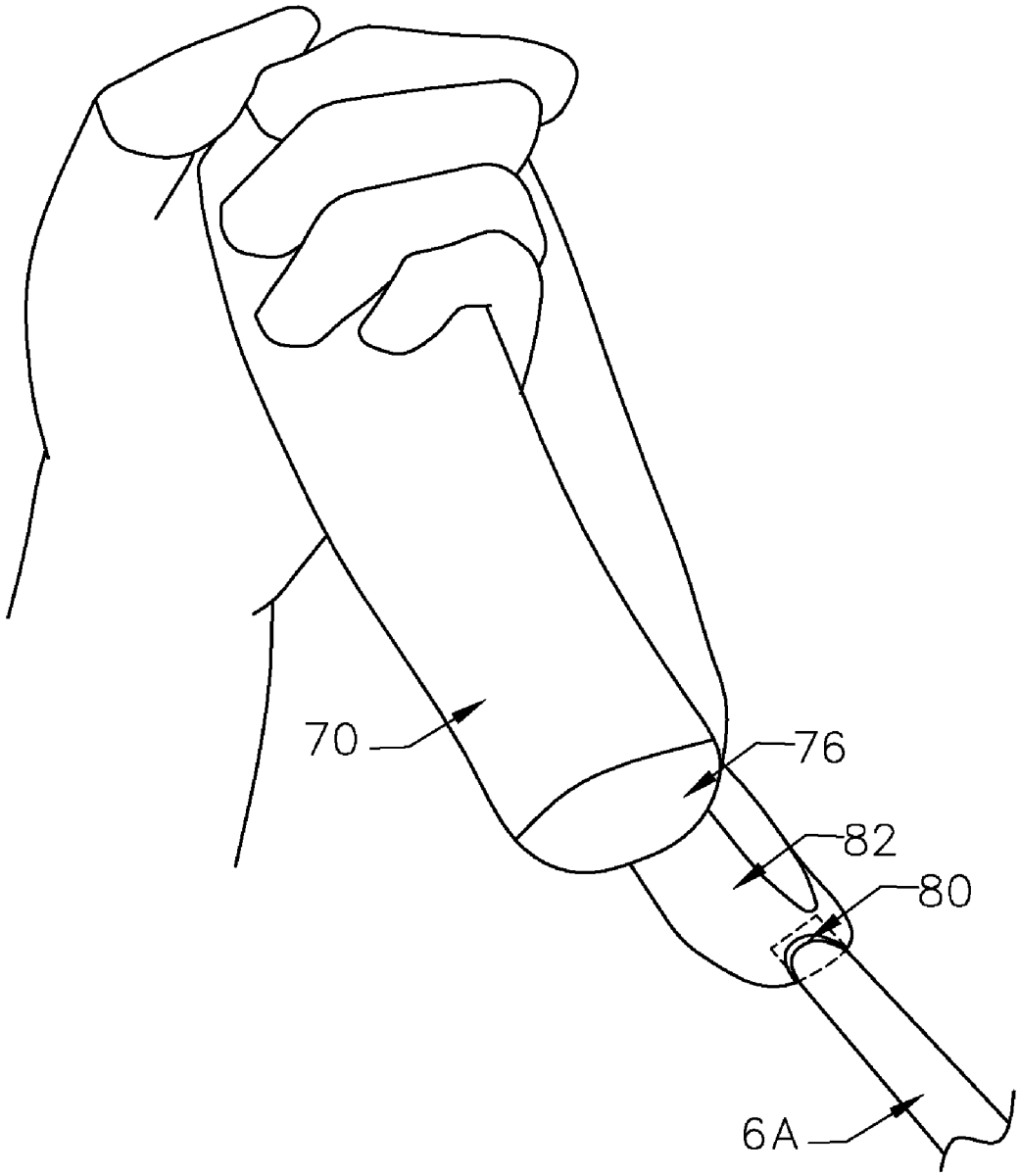

As noted above, FIGS. 1-7D herein illustrate the use of an air-brake safety device at the mid-section of the resistance band of an exercise device, and FIGS. 7E and 7F 7D herein illustrate the use of an air-brake safety device at the opposed ends of the resistance band exercise device, as well as at the mid-section, so as to make a totally safe exercise resistance band device.

Figure 1:
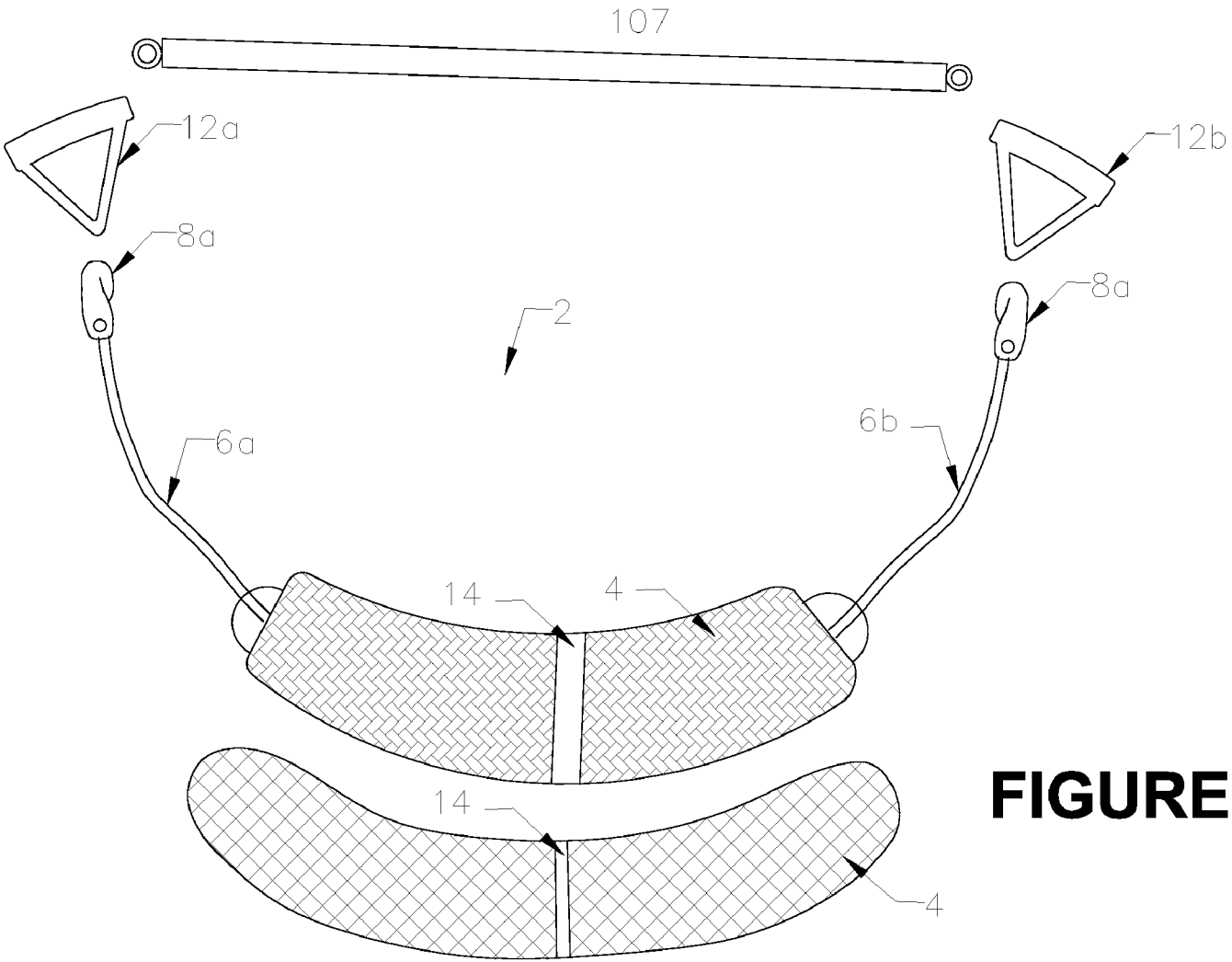
FIG. 1 illustrates an exercise resistance band showing the safety device located midway from the ends of the resistance band, for reducing the snap back effect in the event of unwanted release of the middle portion from a retained position, and alternative attachment devices.
Figure 2:
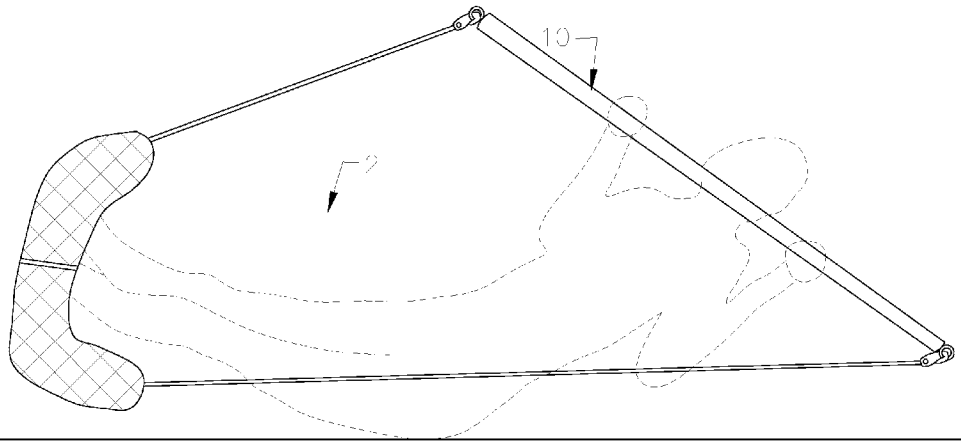
FIGS. 2, 4, 5 and 6 illustrate the exercise resistance band of FIG. 1 connected to a bar-type user gripping device.
Figure 3:
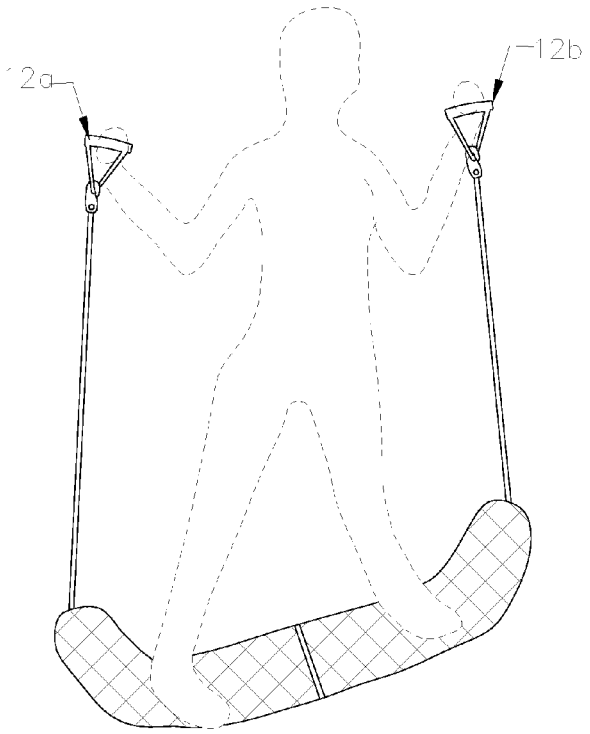
FIG. 3 illustrates the exercise resistance band of FIG. 1 connected to individual user gripping devices, i.e., handles, of the conventional type.
Figure 4:
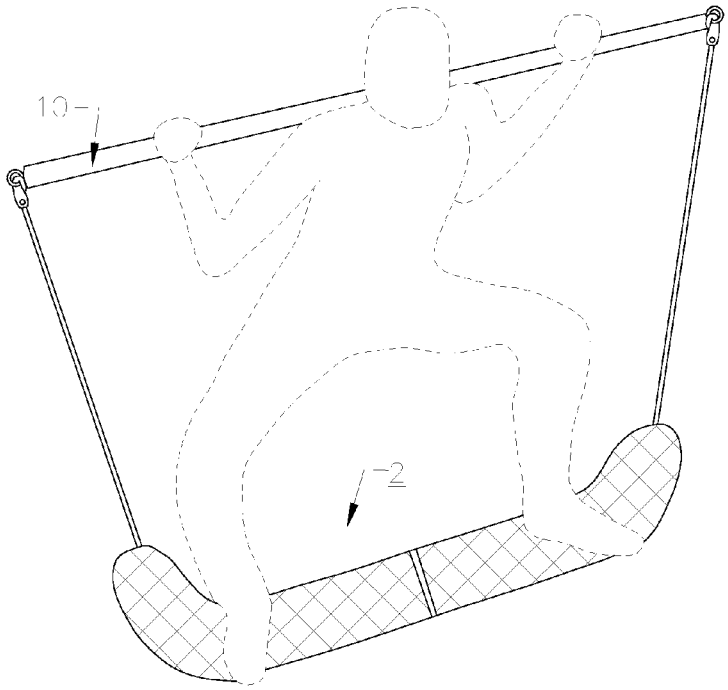

FIG. 1 illustrates one embodiment of a resistance band exercise device 2. The resistance band exercise device 2 includes a portion 4 in the center which may be referred to as a safety net, air brake or Para-mount section. It is the device portion 4 that provides the air resistance which will substantially reduce or eliminate the snap back effect in the event of a mount or placement failure causing an unwanted release of the center portion of the band 2. This device portion 4 can be made of a netting type of nylon material (as shown by device 4'), or may comprise an air impervious material 4, such as used in parachutes, and have a shape of approx 30" in length and 6"-12" in width (plus or minus 25%, as any given design may require) so as to catch the air in the event the band snaps back. The device portion 4 may be gathered at its opposing ends so as to form an overall cupped or parachute type of shape for the center portion of the band 2, and the ends are securely attached to approximately 18" to 24" inches of elastic band material 6*a* and 6*b*. Small clips or fasteners 8*a* and 8*b* are secured at each of the remote ends of the bands 6*a* and 6*b*, respectively, for attaching the improved band 2 to any type of exercise equipment which uses a resistance band. For example, typically, such a resistance band is attached to an exercise bar 10 or handles 12*a* and 12*b* (FIGS. 2 and 4 show an embodiment of the invention where the inventive band 2 is used with an exercise bar 10, and FIG. 3 shows an embodiment of the invention where the inventive band 2 is used with handles 12*a* and 12*b*, respectively.)

Typically, the elastic band material 6*a* and 6*b* are formed of surgical tubing or other elastic, resistive material, such as "Thera-Bands"®. The band material is conventionally attached to a plastic clip or fastener, such as shown in FIG. 1, as well known by those of ordinary skill in this art. The opposite ends of the bands can be attached to the device portion 4 at a mounting hole/area formed at the opposite ends of device portion 4, by means of a loop knot attachment, or just a knot, as well known by those of ordinary skill in this art.

Additionally, in a further alternative embodiment the device portion 4 includes a strip of flexible material 14 sewn or otherwise affixed to the center portion of device portion 4, which material aids in the mounting of the device portion 4 to a mounting device, such as a door, as will be described in greater detail with respect to FIG. 6.

Referring again back to FIG. 1, in that event that during the tension phase of the resistance band exercise device 2, the elastic bands 6*a* or 6*b*, or one of their mountings were to suffer a failure, the cupped or parachute shape of the device center portion 4 is designed so that the wind caused by the sudden release of the band, would cause the device center portion 4 to "billow out" or stated another way, to "deploy" so that the air caught by the device center portion 4 would "drag" and greatly slow down the movement of the band, thereby greatly reducing or substantially eliminating the snap back effect. This effect is also proved with different materials being used for the device center portion 4, such as the parachute or netting material shown in FIG. 1.

As shown in FIGS. 2, 3 and 4, the present resistance band exercise device 2 also allows for safe mounting and dismounting of an exercise device 2, for example under the feet or a foot of the user, by the fact that the center portion 4 creates a larger mounting area than if just the elastic band 6*a* or 6*b* itself were to be used to do the mounting. The safety increase results from the increased area of center portion 4 as well as the material from which it is constructed, as compared with the elastic material of the remainder of the band 2. More specifically, when center portion 4 is made of a mesh or even parachute material, the increased area of the material of center portion 4 provides for much more frictional contact between the center portion 4 and the underside of the user's feet, thereby making an unwanted release of the mounting extremely unlikely. Additionally, because the center portion 4 is substantially flat, as compared with the hard round structure of the resistance/elastic band surgical tubing, even if the user were to use the improved exercise device while being "barefoot" there would be no discomfort to the bottom of the user's foot, which the user would have suffered if they were using the prior art device due to standing on the hard round elastic tubing, since with the present invention, the user will have the soft/flat center portion 4 under his/her foot.

Furthermore, there would be no tendency for the elastic band material (such as surgical tubing) to "roll-out" from under the user's foot and cause an unwanted release, because the center portion 4 will lay flat under the user's foot. And even if an unwanted release were to occur during the tension phase of the elastic band material, due to the sudden and rapid movement during a "snap-back" action, the center portion 4 will "deploy" and the air resistance effect caused by the sudden movement will act as an "air brake" and greatly slow down the movement of the elastic band material, thereby reducing or substantially eliminating the snap-back effect.

Figure 5:
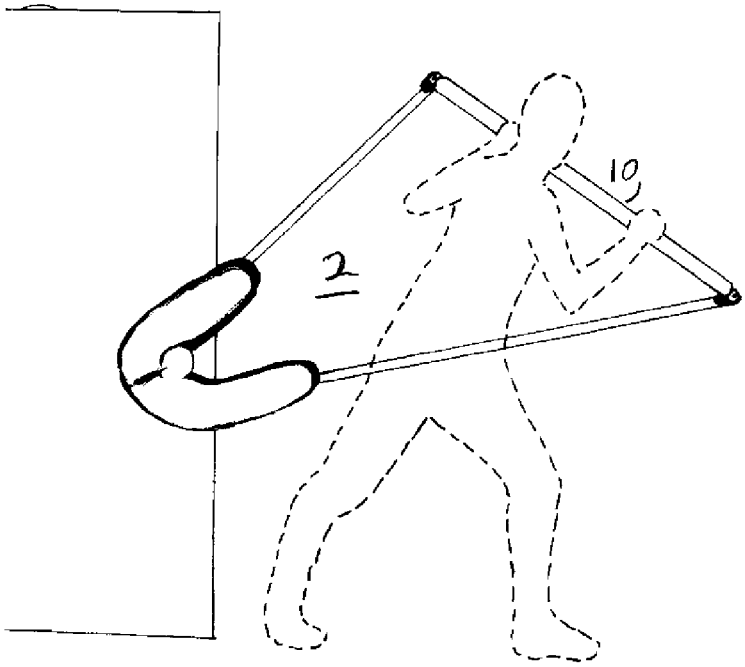

The same advantages can apply with respect to door or frame mounted exercise resistance bands. Not only does the center portion 4 act as a safe mounting part of the exercise device, but it provides for a secure mount in a relatively fail-safe manner. As seen in FIG. 5, the mesh or parachute material of the center portion 4 can simply be placed on the doorknob opposite the user to provide a door mount. Due to the increased width of the center portion 4, as well as its texture, it is very unlikely to "slip" off of a doorknob. Even in the unlikely event of an unwanted release of the center portion 4 from the doorknob mounting, the air resistance effect against the center portion 4 of mesh or chute material will substantially slow down the snap-back of the device 2, thereby greatly lower the risk and potential for injury to the user, a person standing nearby, and/or damage to property. Additionally, because the thickness of center portion 4 is so much less than the diameter of the conventional resistance band material (surgical tubing), the door can be even be closed so as to provide even extra safety for the mounting of the exercise device 2 to a door.

Additionally, when the center portion 4 is mounted to a door knob as seen in FIG. 5, or a door frame as seen in FIG. 6, it is less likely to damage or mar the door frame as seen commonly with current door mounts for such devices. In this regard, the center portion 4 of the present invention also includes center portion 14, as an added safety measure. Portion 14 is a strip of flexible material which reinforces and thickens the center portion 4, so that when mounted without the use of a doorknob as seen in FIG. 6, there is added resistance and thickness which help to avoid unwanted slippage from the doorframe.

In another user technique, instead of mounting the center portion 4 to a door or securing it under the user's feet, a trainer or partner standing opposite the user can grasp center portion 4 with his/her hands. In this technique, the center portion 4 provides a much more secure, comfortable (less abrasion) and allergy-free place for the trainer or partner to grab center portion 4. Another side benefit is that the trainer's hands don't smell like rubber or surgical tubing at the end of the day, and potential allergic affects are avoided Thus, the present invention provides an extremely safe exercise resistance band, which is particularly appropriate for use by personal trainers, fitness centers, children and seniors.

FIGS. 7A, B and C illustrate details for one embodiment of the central portion 4 of the safety device. As shown by FIGS.

7A and 7B, the safety device basically comprises a substantially rectangular piece of strong and light-weight flexible material 70 having substantial air resistance, such as 200 denier rip-stop nylon. The dimensions of this substantially rectangular piece of material 70 is approximately 11 inches in height by approximates 36 inches in length, plus or minus about 25%, depending upon what dimensions would be provide sufficient air drag/braking in a particular design. This rectangular piece of material 70 is gathered at its opposing ends so as to form an overall cupped or parachute type of shape (as noted in the forenoted description of FIG. 1), by sewing each of the opposed ends of the material onto a circular piece of flexible material 76 shown in FIG. 7C, along with a strip-like tab of flexible material 72 and 74 at the respective opposed ends of material 70. Each of the tabs 72 and 74 are several inches long and have a hole formed therein (and preferably a grommet 80 and 80', which surround the hole in tabs 72 and 74, respectively) which are used for attaching the resistance bands 6*a* and 6*b* (shown in FIG. 1) to material 70. The previously noted "cupped-shape" for the safety device is ensured by the gathering of the opposed ends by sewing the opposed ends to the circular end pieces 76. The end pieces 76 shown in FIG. 7C have, for example, a perimeter of 12 inches, while the rectangular piece 70 of FIG. 7B has a height of about 11 inches, thereby leaving a one inch gap at the cup-shaped ends for air to enter the safety device and "deploy" its cup shape into a parachute-type "air brake", thereby significantly slowing down movement of the portion of the resistance band that is connected to the safety device. A centrally located support device, similar to device 14 shown in FIG. 1, could also be advantageously used in the FIG. 7A embodiment, so as to provide a "stiffness" to the material 70 which forms central portion 4, and thereby help ensure rapid "inflation" of the safety device upon its' movement through air.

In order to even furthermore help ensure that the safety device becomes sufficiently inflated with air so as to create an effective air-brake upon its' rapid movement through the air, FIG. 7C also shows the use of a plurality of holes 78 which are cut into the material which forms end 76. Holes 78 are dimensioned so as to let air pass into the cup-shaped central portion 4.

In an even further improvement, it is noted that sheet-like material 70 may have introduced on one side thereof a "sticky" coating, which coating increases the tendency of the grasp provided by the user (i.e., either a hand or foot) to remain positioned on said sheet-like material 70 when the elastic band is under tension, and not slip off of material 70.

In accordance with the present invention, FIGS. 7D, 7E and 7F show one embodiment of an inventive modification of the safety device shown by FIGS. 1 to 7C, which adapt it for use as a safety handle for a resistance band exercise device. More specifically, as shown in FIG. 7D, the substantially rectangular piece of material for forming the cup-shape, is reduced in size to approximately one-half of the dimension used in the prior example, and thus is about 18 inches long and about 11 inches high. An additional change from FIG. 7A is that instead of having the two tabs 72 and 74 which are used for attachment to the one end of each of two resistance bands 6*a* and 6*b*, a single tab "bridge" 82 is provided to extend across the opposed ends of the sheet material, so as to leave a gap in the middle, to help ensure air can enter into the cup-shaped parachute. The bridge 82 can be formed by sewing together the opposed tabs 72 and 74 in an overlapped relation, thereby making a relatively stiff bridge which brings the opposed ends of the rectangular sheet material together, thereby helping ensure that the opposed ends stay somewhat spaced-apart, and facilitating the entry of air into the curved material of the safety handle. The handle end of each of the two resistance bands 6*a* and 6*b* is then connected to a grommet 80 formed in the bridge tab 82, so that the air-drag safety device can be easily used as a handle by the users hand (as shown by FIG. 7F) or foot (as shown by FIG. 7E).

In a further embodiment, not specifically shown, it is noted that the inventive safety handle such as shown herein can be used "in addition" to use of a conventional type of user grasping device, i.e., a short bar-shaped plastic or foam handle connected to each of the opposed ends of the elastic resistance band.

The present invention provides a restraining portion for a resistance band that is more versatile and comfortable than what used in the prior art resistance band devices, in that they can be easily and safely attached to the users wrist, ankles or feet. In this regard, it can also be easily adapted for use with people who have weak or no grip, such as users with carpel tunnel injury or even amputees. With the present invention, such people can securely, safely and comfortably have a resistance band exercise device attached to their remaining appendages (upper arms, forearm, upper or lower leg, etc.)

Thus, in a broader aspect of the invention, it is obvious that a method is provided for improving the safety and versatility of a resistance band device, by securing a device to an end of the resistance band, which can act as a "safety brake" and provide air-drag in the event that an end of the resistance band sustains a sudden release from tension, which release can cause the released end to move rapidly through the air, and possibly hurt anyone that would come into contact with it.

In all of the embodiments disclosed herein, attachment of the resistance band to the safety device, when the resistance band comprises surgical tubing, can not only be accomplished using the knot technique previously noted, but can also be easily accomplished using the well known "wedge" technique. In this method of attachment, a wedge shaped bead or obstruction having a diameter about the same size or larger than the diameter of the grommet in the safety handle to which an end of the resistance band is to be attached, is inserted inside of the open end of the surgical tubing after it has passed through the grommet. Then, once inserted, the wedge shaped bead becomes a "stopper" or obstruction that prevents the end of the surgical tubing from being removed from the grommet, and in fact, it becomes "jammed" into the grommet, further securing that end to the grommet.

While this invention has been particularly shown and described with references to preferred embodiments thereof, it will be understood by those skilled in the art that various changes in form and details may be made therein without departing from the spirit and scope of the invention. Some of such changes are alternative materials for the parachute-shaped center portion 4, or even the use of the parachute shaped handles in addition to a conventional handle made of a material having a fixed shape, as noted above. In an embodiment such as this, the para-handle would provide a safety air-brake and slow down movement of the fixed-shape handle in the event of a sudden release, thereby preventing or substantially reducing injury or damage that the conventional handle of fixed shape would cause. It should be realized that the above-noted changes are not exhaustive, and merely exemplary. Those skilled in the art will recognize, or be able to ascertain using no more than routine experimentation, many equivalents to the specific embodiments of the invention described herein. For example, center portion 4 can have different lengths and widths or be constructed of different materials (non-elastic or elastic materials, as desired), so as to have different aerodynamic properties, or improve efficacy, as desired.

All such changes and modifications are considered to be within the spirit and scope of the invention.

The invention claimed is:

1. An elastic resistance band exercise device, comprising;

an elastic resistance band portion having first and second opposed ends, where each of the first and second ends is attached to a respective one of a first and second user grasping device so a user can stretch said elastic resistance band and establish an elastic tension between said first and second user grasping devices;

wherein each of said a first and second user grasping device comprise a sheet-like material having a substantially elongate shape and having its opposed ends connected together at a common point, said common point serving as an attachment location of said first and a second user grasping devices to a respective one of said first and second ends of said elastic resistance band portion; and wherein by connecting said opposed ends of said sheet-like material together, each of said user grasping devices functions so as to provide an air brake to said respective end of said resistance band in the event said user grasping device is suddenly release from the user's grasp while said resistance band is under tension.

2. The resistance band device of claim 1, where the width of the sheet-like material is in the range of about 6 inches to about 12 inches, and the length of the sheet-like material is in the range of about 12 to 20 inches.

3. The resistance band device of claim 1, where the sheet-like material is substantially impervious to air.

4. The resistance band device of claim 1, where in addition to connection at each opposed end of the elastic resistance band of the user grasping device comprising a sheet-like material, a further user grasping device is used of the type having a fixed-shape handle.

5. The resistance band device of claim 1, where a portion of said elastic resistance band that is midway between said opposed ends is replaced with a sheet-like material having a generally rectangular shape so as to form a safety device for a central portion of said elastic resistance band.

6. The resistance band device of claim 5, where the opposed ends of said sheet-like material at said central portion are gathered together so as to cause said sheet-like material to form a cupped shape at its ends, thereby causing said sheet-like material to have a tendency to billow in the air upon rapid movement of said central portion through air, said central portion thereby presenting a substantial friction against air so to create an air-brake effect which will significantly slow down movement of the central portion in the event the central portion is forced to move rapidly through air, thereby reducing the likelihood of injury to a user of the exercise device.

7. The resistance band device of claim 5, where the sheet-like material of the central portion has a coating on a side thereof which increases the tendency of the grasp provided by the user to remain positioned on said sheet-like material.

8. A method for reducing impact force generated from a released end of an elastic resistance band portion of an exercise device, comprising:

connecting each of opposed ends of a resistance band to a respective one of a piece of generally rectangular sheet material which has its opposed ends connected together so as to form and serve as a user grasping handle for each of the opposed ends of said resistance band; and releasing at least one of said sheet material handles while said elastic resistance band is under tension, whereby said sheet material handle functions as an air brake upon rapid movement through the air, thereby reducing impact force generated from said releasing.

* * * * *